US008353724B2

(12) United States Patent
Shi et al.

(10) Patent No.: US 8,353,724 B2
(45) Date of Patent: Jan. 15, 2013

(54) CABLE CONNECTOR ASSEMBLY HAVING MEANS FOR LIMITING CABLES THEREOF FROM SWINGING

(75) Inventors: Xian-Kui Shi, Shenzhen (CN); Jin-Zhi Chen, ShenZhen (CN); Chung-Yen Yang, Tu-Cheng (TW)

(73) Assignee: Hon Hai Precision Ind. Co., Ltd, New Taipei (TW)

( * ) Notice: Subject to any disclaimer, the term of this patent is extended or adjusted under 35 U.S.C. 154(b) by 146 days.

(21) Appl. No.: 12/944,759

(22) Filed: Nov. 12, 2010

(65) Prior Publication Data

US 2011/0111631 A1 May 12, 2011

(30) Foreign Application Priority Data

Nov. 12, 2009 (CN) ..... 2009 2 0314586 U

(51) Int. Cl.
*H01R 13/40* (2006.01)
*H01R 13/46* (2006.01)

(52) U.S. Cl. ..... 439/625; 439/540.1

(58) Field of Classification Search ..... 439/625, 439/540.1, 541.5, 499
See application file for complete search history.

(56) References Cited

U.S. PATENT DOCUMENTS

| | | | | |
|---|---|---|---|---|
| 6,045,390 | A * | 4/2000 | Metz et al. | 439/405 |
| 6,210,204 | B1 * | 4/2001 | Ko et al. | 439/404 |
| 6,494,749 | B1 * | 12/2002 | Chang | 439/701 |
| 6,699,075 | B1 * | 3/2004 | Ko | 439/607.48 |
| 7,553,191 | B2 * | 6/2009 | Su et al. | 439/637 |
| 7,641,514 | B2 * | 1/2010 | Chen et al. | 439/540.1 |
| 7,803,009 | B2 * | 9/2010 | Su et al. | 439/492 |
| 7,806,722 | B2 * | 10/2010 | Yu et al. | 439/540.1 |
| 8,057,261 | B1 * | 11/2011 | DeSio et al. | 439/625 |
| 2008/0188136 | A1 * | 8/2008 | Su et al. | 439/660 |
| 2008/0214045 | A1 * | 9/2008 | Tu et al. | 439/540.1 |
| 2009/0269977 | A1 * | 10/2009 | Chen et al. | 439/540.1 |

FOREIGN PATENT DOCUMENTS

TW M243805 9/2004

* cited by examiner

*Primary Examiner* — Hae Moon Hyeon
(74) *Attorney, Agent, or Firm* — Wei Te Chung; Ming Chieh Chang

(57) ABSTRACT

A cable connector assembly includes an insulative housing, a connector section retained in the insulative housing, a cable electrically connecting with a rear side of the connector section, and a cover fastened at a rear end of the insulative housing. The insulative housing defines a cavity opening outwardly along a first direction. The connector section is received in the cavity. The cable extends out of the insulative housing. The cover holds the cable to make the cable bend along a second direction perpendicular to the first direction and preventing the bent cable from swinging.

14 Claims, 5 Drawing Sheets

CABLE CONNECTOR ASSEMBLY HAVING MEANS FOR LIMITING CABLES THEREOF FROM SWINGING

BACKGROUND OF THE INVENTION

1. Field of the Invention

The present invention relates to cable connector assemblies, more particularly to cable connector assemblies having means for limiting cables thereof from swinging.

2. Description of Related Art

Cable connector assemblies are employed widely in variety electronic devices for electrically connecting different components or electronic devices with each other. A cable connector assembly usually includes a connector section and at least a cable connecting a rear end of the connector section. The connector section has an insulative housing and a plurality of contacts retained in the insulative housing to electrically connect with a mating receptacle connector. The cable electrically connects a rear end of the contacts and extends along a mating direction of the mating receptacle connector.

However, as the electronic devices are increased, there is no more space behind the connect section to receive the cable along the mating direction, and there is not enough assembling space to assemble the common cable connector assembly to the electronic device. For solving above problem, engineers design a new type cable connector assembly which has a connector section and a bent cable connecting a rear end of the connector section for decreasing an assembling space thereof. The bend cable has a level portion connecting the connector section along a mating direction of a mating receptacle connector and a vertical portion downwardly extending from the level portion. An insulative housing of the connector section is formed with a small protrusion protruding to a rear side of the vertical portion for ensuring the vertical portion bending downwardly. However, the small protrusion can not stably hold the cable, and the cable is easily pulled to escape from the small protrusion; then the vertical portion would rebound outwardly and locate at a rear side of the level portion, which is inconvenient to be used or assemble for consumers.

Hence, an improved cable connector assembly is desired to overcome the above problems.

BRIEF SUMMARY OF THE INVENTION

According to one aspect of the present invention, a cable connector assembly, comprises: an insulative housing defining a cavity opening outwardly along a first direction; a connector section retained in the cavity; a cable electrically connecting with a rear side of the connector section and extending out of the insulative housing; and means holding the cable to make the cable bend along a second direction perpendicular to the first direction and preventing the bent cable from swinging.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENTS

Figure 1:
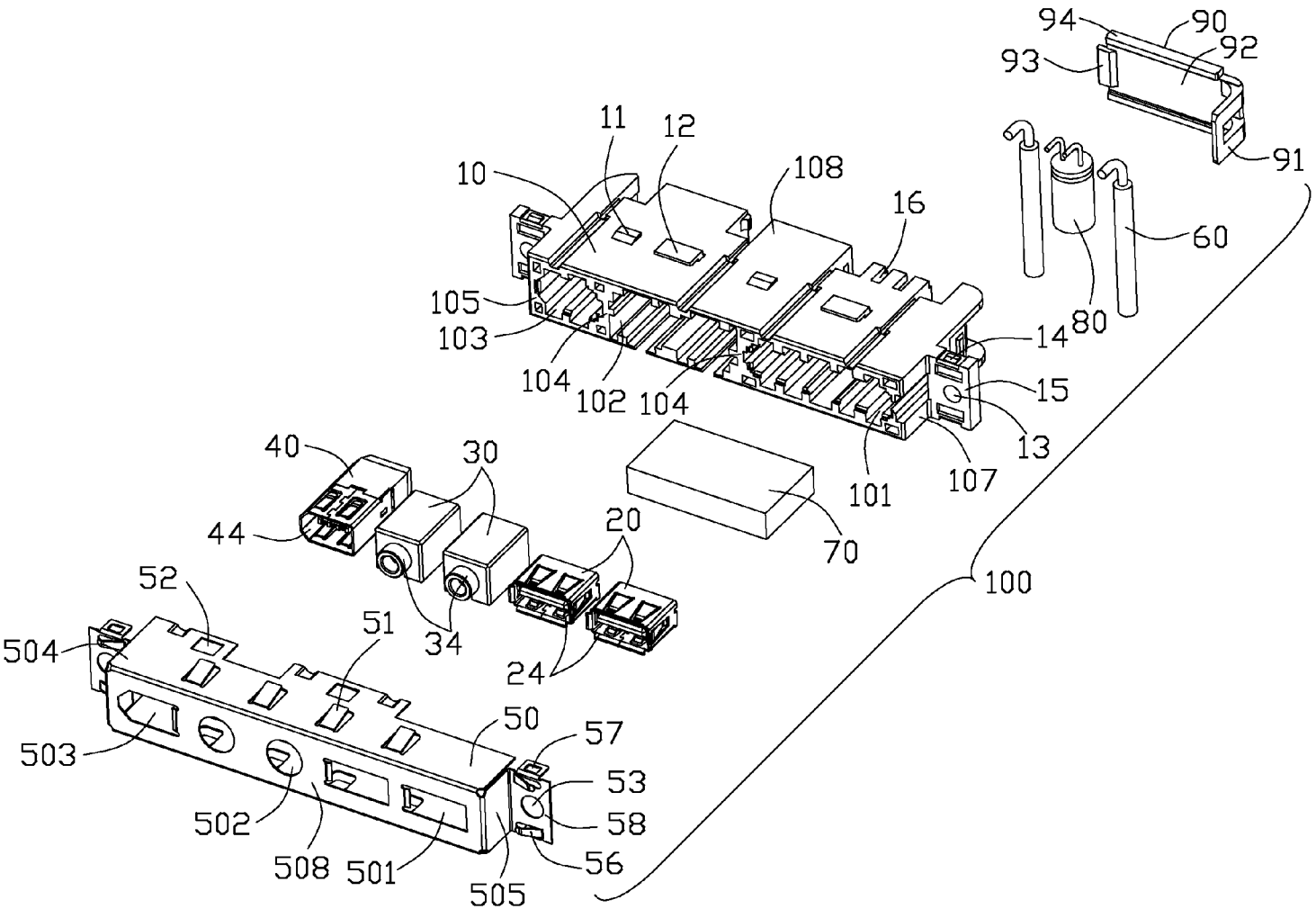
FIG. 1 is an exploded view of a cable connector assembly according to the present invention.

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Reference will be made to the drawing figures to describe the present invention in detail, wherein depicted elements are not necessarily shown to scale and wherein like or similar elements are designated by same or similar reference numeral through the several views and same or similar terminology.

Referring to FIGS. 1-5, a cable connector assembly 100 according to the present invention is disclosed. The cable connector assembly 100 comprises an insulative housing 10, two first connector sections 20, two second connector sections 30, a third connector section 40, a metal shell 50 covering the insulative housing 10, a plurality of cables 60 connecting a rear end of the connector sections 20, 30, 40, and a cover 90 covering a rear side of the cables 60 to prevent the cables 60 from swinging.

Figure 2:
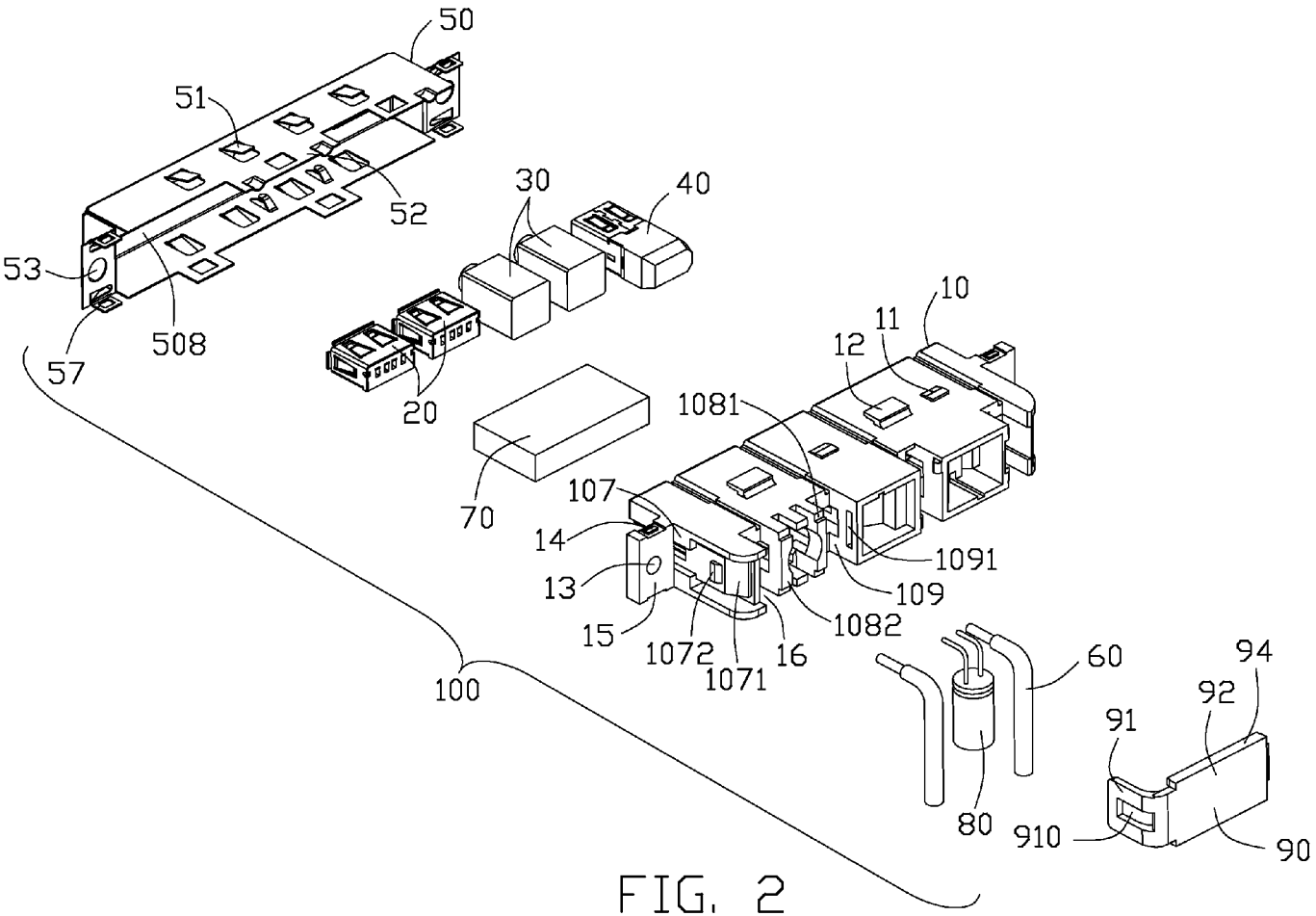
FIG. 2 is a view similar to FIG. 1, while taken from a different aspect.

Referring to FIGS. 1 and 2, the insulative housing 10 has an elongated base portion 108. The base portion 108 has a front surface 105, and a plurality of cavities extending backwardly from the front surface 105, thereby the cavities open outwardly along a first direction. The first direction is a back to front direction in the present invention. The cavities comprise two first cavities 101 at right position thereof, two second cavities 102 at middle position thereof, and a third cavity 103 at left position thereof. The two first cavities 101 communicate with each other along a fourth direction perpendicular to the first direction. The second cavities 102 communicate with each other along the fourth direction. The base portion 108 is formed with two partition walls 104 between the first and second cavities 101, 102, and the second and third cavities 102, 103 to separate the first, second and third cavities 101, 102, 103 with each other. The insulative housing 10 is formed with a pair of ear portions 15 outwardly extending from two sides of the base portion 108 along the fourth direction. The ear portions 15 is formed with a position hole 13 at a middle position thereof and a pair of wedge protrusions 14 at upper and lower sides thereof to engage with the metal shell 50.

The base portion 108 has a first side wall 107 at outside of the first cavity 101, a second side wall 109 backwardly extending from the partition wall 104 between the first cavity 101 and the second cavity 102 along a third direction opposite to the first direction. The second side wall 109 extends beyond the first side wall 107 along the third direction. One of the ear portions 15 extends from the first side wall 107. The first side wall 107 is formed with an arc recess 1071 at a rear side thereof and located behind the ear portion 15, and a wedge first block 1072 outwardly protruding from an inner wall of the recess 1071 along the fourth direction. The second side wall 109 defines a fixing hole 1091 extending therethrough along the fourth direction to lock with the cover 90. The base portion 108 is formed with a plurality of wedge projections 11 and L-shaped limitation blocks 12 upwardly extending from a top side thereof to engage with the metal shell 50.

A plurality of slots 16 extends through a rear end of the base portion 108 along a second direction perpendicular to the first and fourth directions. The slots 16 open outwardly along the third direction and located behind the first cavities 101. The base portion 108 has a rear wall 1082 and a pair of depressions 1081 respectively recessed from upper and lower end of the rear wall 1082.

Referring to FIGS. 1 and 2, the first connector sections 20 in the present invention are a pair of standard USB receptacle connectors and are side by side disposed in the first cavities 101. Each first connector section 20 defines a rectangular first mating hole 24 to mate with a corresponding USB plug (not shown). The second connector sections 30 in the present invention are a pair of common Audio jacks and are side by side disposed in the second cavities 102. Each second connector section 30 defines a round second mating hole 34 to mate with an Audio plug (not shown). The third connector section 40 in the present invention is an IEEE 1394 connector and is disposed in the third cavity 103. The third connector section 40 defines a hexagonal third mating hole 44 to mate with an IEEE 1394 plug (not shown). The cable connector assembly 100 in the present invention has a plurality of cables respectively electrically connect with the first, second and third connector section 20, 30, 40, and the cable connector assembly 100 in the present invention justly shows cables 60 used to connect with the first connector sections 20.

Figure 3:
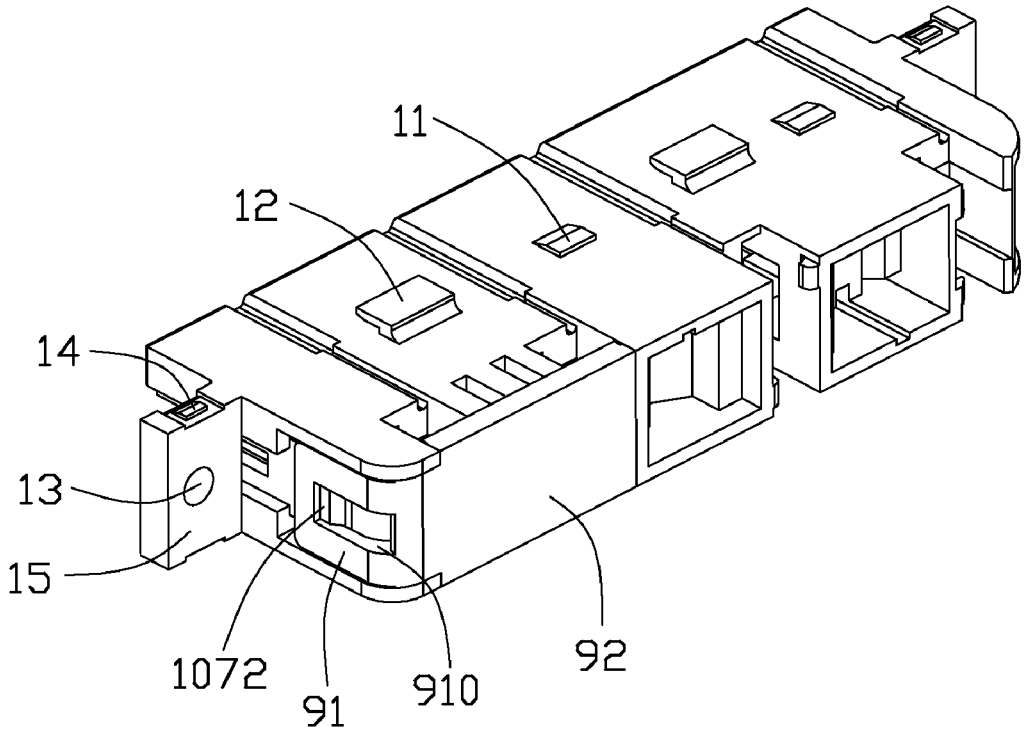
FIG. 3 is a partly perspective view of the cable connector assembly shown in FIG. 1.
Figure 4:
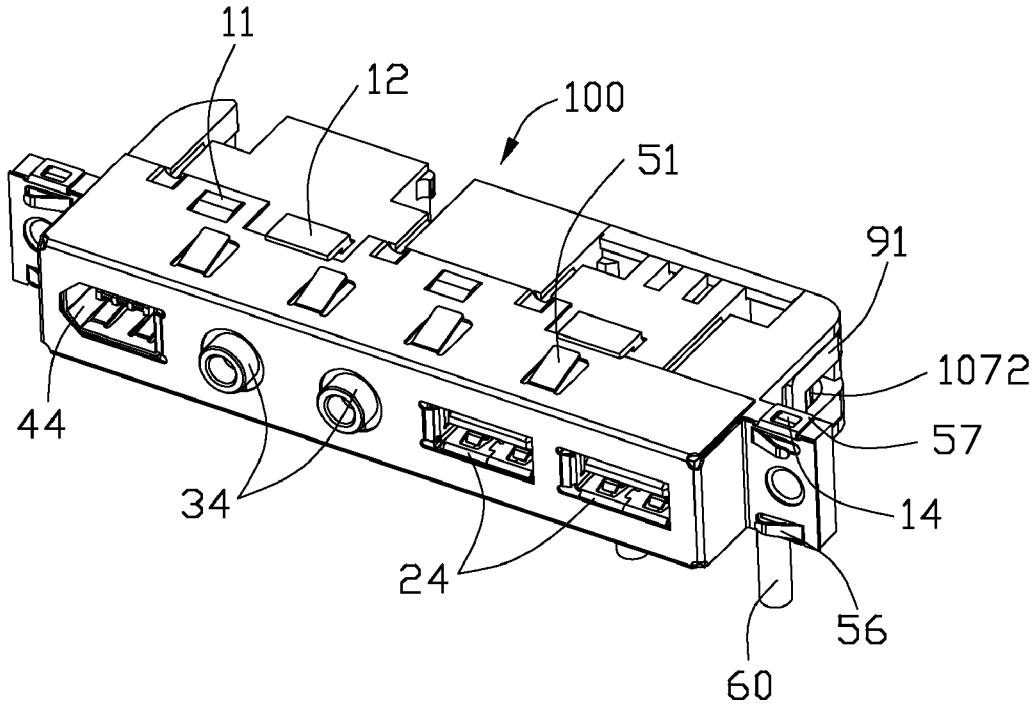
FIG. 4 is a perspective view of the cable connector assembly shown in FIG. 1.

Referring to FIGS. 1, 2 and 3, the metal shell 50 is stamped by a metal sheet and covering a front side of the insulative housing 10. The metal shell 50 has a front wall 508, a pair of level walls 504 respectively extending from upper and lower ends of the front wall 508 along the third direction, and a pair of side walls 505 respectively extending from left and right ends of the front wall 508.

The front wall 508 defines a pair of rectangular first openings 501 corresponding to the first mating holes 24, a pair of round second openings 502 corresponding to the second mating holes 34, and a hexagonal third opening 503 corresponding to the third mating hole 44. The metal shell 50 further has a pair of locking tab 58 outwardly extending from rear ends of the side walls 505 along the fourth direction. Each locking tab 58 defines a locking hole 53 aligned to the position hole 13 along the third direction for engaging with a bolt (not shown). The level walls 504 are formed with a plurality of first spring tabs 51 outwardly extending to engaging with a shell of an electronic device (not shown) for grounding, and a plurality of fixing holes 52 at a rear side thereof to lock with the projections 11 on the base portion 108. Each locking tab 58 has a pair of second spring tabs 56 forwardly projecting for grounding. Each locking tab 58 has a pair of fasten tabs 57 backwardly extending from upper and lower ends thereof along the third direction to fasten with the wedge protrusions 14.

The cover 90 presents as L-shaped and has a flat body portion 92 extending along the fourth direction, a long locking portion 91 extending from one side of the body portion 92 along the first direction to engage with the arc recess 1071 of the first side wall 107, and a pair of flanges 94 respectively extending from upper and lower ends of the body portion 92 along the first direction to engage with the depressions 1081. The body portion 92 forwardly covers the slot 16 to resist the cable 60 for making the cable 60 bend along a second direction and preventing the cable 60 from swinging. The locking portion 91 defines a locking hole 910 to engage with the first block 1072. The locking portion 91 is formed as an oblique arc arm received in the arc recess 1071 to make a mold (not shown) which is used to form the locking hole 910 can move along the first or third direction. The cover 90 has a second block or short hook 93 extending along the fourth direction from a free end of the body portion 92 to lock with the fixing hole 1091. The depressions 1081 of the insulative housing 10 does not extend through the first and second side walls 107, 109 along the fourth direction, which can prevent the flanges 94 from moving along the fourth direction. The body portion 92 has a rear face located at a common plane with the rear wall 1082.

Figure 5:
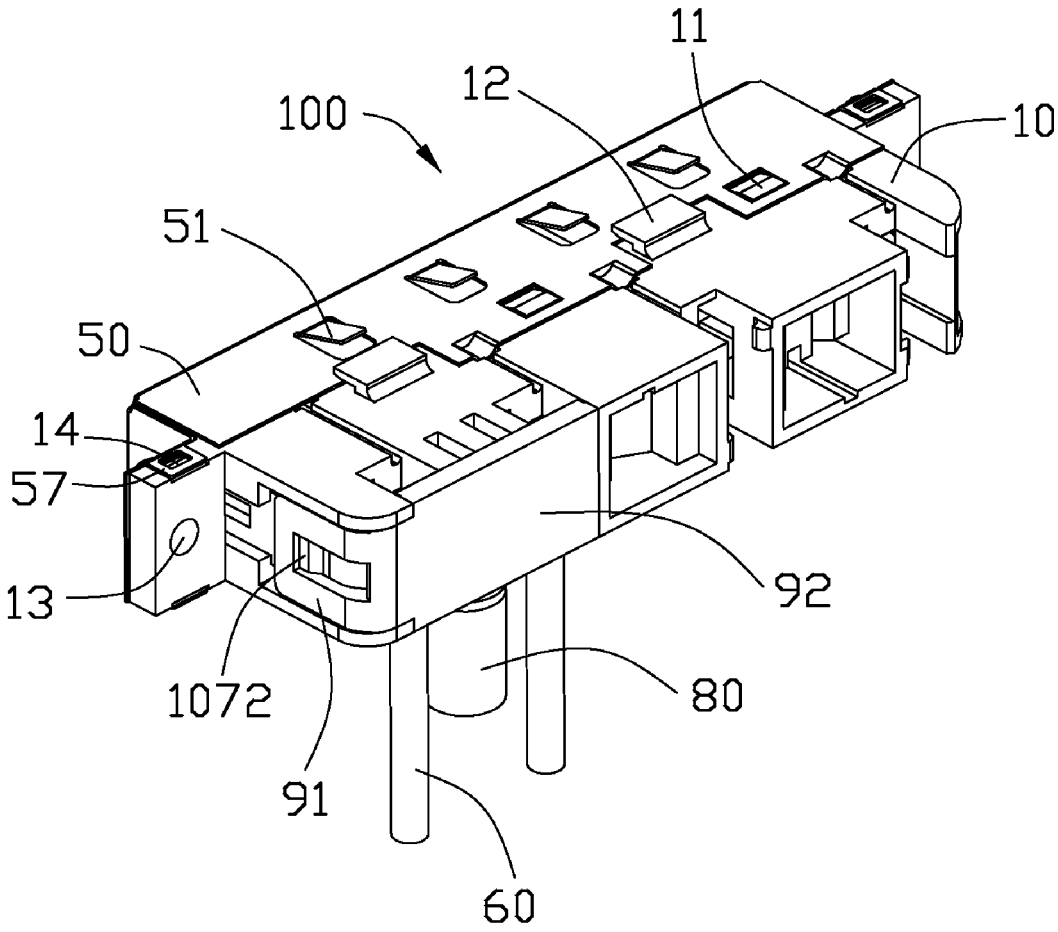
FIG. 5 is a view similar to FIG. 4, while taken from a different aspect.

Referring to FIGS. 1-3 and 5, in assembly of the cable connector assembly 100: firstly, soldering the cables to a rear end of the first, second and third connector sections 20, 30, 40, referring to FIG. 5, the cables 60 are soldered at a rear side of the first connector sections 20 in the present invention; besides, the cable connector assembly 100 further has a capacitor 80 soldered between the first connector sections 20 for filtering; secondly, insert molding an insulator 70 around the connecting portions between the first connector sections 20, the cables 60 and the capacitor 80; thirdly, assembling the first, second and third connector sections 20, 30, 40 with the cables to the first, second and third mating cavities 101, 102, 103 respectively along the third direction, and the cables extend through the slots 16 and to exterior from a rear side of the body portion 108; fourthly, assembling the metal shell 50 to the insulative housing 10 along the third direction, then a rear end of the level walls 504 is located below the limitation blocks 12; finally, assembling the cover 90 to the insulative housing 10, the flat body portion 92 forwardly pressing a rear side of the cables 60 to make the cables 60 bend downwardly in the slots 16 and can not swing.

As fully described above, the cover 90 forwardly presses a rear side of the cables 60 to make the cables 60 bend downwardly along the second direction, and covers a rear side of the slots 16 for remaining the cables 60 in the slots 16 and preventing the cables 60 from being pulled to escape from the slots 16 along the third direction; thereby the cable connector assembly 100 has a small length along the third direction and can be conveniently assembled. A means for remaining the cables 60 bending along the second direction and not swinging is the cover 90 of the cable connector assembly 100 in the present invention. Of course, the means can be alternatively designed as a crossbeam connecting opposed two inner side walls of each slot 16 along the fourth direction to ward off the cables 60 and make the cables 60 bend along the second direction and not swing along the third direction.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. A cable connector assembly, comprising:

an insulative housing defining a cavity opening outwardly along a first direction;

a connector section retained in the cavity;

a cable electrically connecting with a rear side of the connector section and extending out of the insulative housing; and means holding the cable to make the cable bend along a second direction perpendicular to the first direction and preventing the bent cable from swinging;

wherein the insulative housing defines a slot opening outwardly along a third direction opposite to the first direction at a rear end thereof to receive the bent cable, and the means has a flat body portion forwardly covering the slot to prevent the bent cable from swinging along the third direction;

wherein the insulative housing has a first side wall and a second side wall extending beyond the first side wall along the third direction, the first side wall is formed with a first block outwardly extending along a fourth direction perpendicular to the first and second direction, and the means has a locking portion extending from one side of the body portion along the first direction to lock with the first block.

2. The cable connector assembly as claimed in claim 1, wherein the slot extends through the insulative housing along the second direction, and the cable extends out of the insulative housing along the second direction.

3. The cable connector assembly as claimed in claim 1, wherein the locking portion defines a locking hole to engage with the first block, the first side wall is formed with an arc recess at a rear end thereof, and the lock portion is formed as an oblique arc arm received in the arc recess to make a mold which is used to form the locking hole can move along the first or third direction.

4. The cable connector assembly as claimed in claim 1, wherein the second side wall defines a fixing hole extending therethrough along the fourth direction, and the means has a second block extending along the fourth direction from another side of the body portion to lock with the block.

5. The cable connector assembly as claimed in claim 1, wherein the insulative housing defines a depression recessed from a rear and upper end thereof, and the means has a flange extending from an upper end thereof along the first direction to engage with the depression.

6. The cable connector assembly as claimed in claim 5, wherein the depression does not extend through the first and second side walls along the fourth direction, which can prevent the flange from moving along the fourth direction.

7. The cable connector assembly as claimed in claim 6, wherein the insulative housing has a rear wall, and the body portion has a rear face located at a common plane with the rear wall.

8. The cable connector assembly as claimed in claim 1, wherein the insulative housing defines a plurality of said cavities side by side arranged along the fourth direction to receive a plurality of said connector section, and a plurality of partition wall between the cavities.

9. The cable connector assembly as claimed in claim 8, wherein the first side wall is located at outside of the insulative housing, and the second side wall extends backwardly from a rear end of a said partition wall along the third direction.

10. A cable connector assembly comprising:

a casing defining a plurality of receiving cavities extending along a front-to-back direction thereof;

a plurality of connectors disposed in the corresponding receiving cavities, respectively, wherein some of said connectors extend beyond a front face of said casing;

a plurality of cables mechanically and electrically connected to rear portions of remaining connectors; and a rear cover attached to a rear face of the casing and regulating said cables to extend in a vertical direction perpendicular to said front-to-back direction while other cables, which are not regulated by said rear cover, are allowed to extend rearward in the front-to-back direction rather than the vertical direction, wherein said rear cover defines a short hook on a lateral side thereof and hidden by the casing, and a long locking portion on another lateral side laterally exposed to an exterior.

11. The cable connector assembly as claimed in claim 10, wherein the rear cover is structured in a L-shape.

12. The cable connector assembly as claimed in claim 10, wherein the short hook extends along a transversal direction, the long locking portion extending along a front-to-back direction.

13. The cable connector assembly as claimed in claim 10, wherein the rear cover further defines a flat body portion, the short hook and the long locking portion are formed at two sides of the flat body portion.

14. A cable connector assembly comprising:

a one piece unitary casing defining a plurality of receiving cavities extending along a front-to-back direction thereof;

a plurality of connectors disposed in the corresponding receiving cavities, respectively, wherein some of said connectors extend beyond a front face of said casing;

a plurality of cables mechanically and electrically connected to rear portions of the remaining connectors; and a rear cover attached to a rear face of the casing and regulating said cables to extend in a vertical direction perpendicular to said front-to-back direction; wherein the casing defines an open on a rear side of each of said some of the connectors so as to allow said some of the connectors to communicate with an exterior rearward in the front-to-back direction rather than the vertical direction; wherein said opening is dimensioned similar to a cross-section of the corresponding receiving cavity.

* * * * *